United States Patent [19]

Stancato

[11] Patent Number: 4,777,753

[45] Date of Patent: Oct. 18, 1988

[54] PROJECTILE CAPTURING GUN SAFETY DEVICE

[76] Inventor: Albert J. Stancato, 921 Henry St., Belle Vernon, Pa. 15012

[21] Appl. No.: 95,266

[22] Filed: Sep. 11, 1987

[51] Int. Cl.[4] ..... F41C 17/08; F42B 11/42

[52] U.S. Cl. ..... 42/70.11; 102/485

[58] Field of Search ..... 42/70.11; 102/485

[56] References Cited

U.S. PATENT DOCUMENTS

| | | | |
|---|---|---|---|
| 2,803,909 | 8/1957 | Soski et al. | 42/66 |
| 2,817,172 | 12/1957 | Lehman | 42/70.11 |
| 2,853,008 | 9/1958 | Bowles | 102/485 |
| 2,887,807 | 5/1959 | Santangelo | 42/1 |
| 3,022,598 | 2/1962 | Wikstrom | 42/66 |
| 3,664,263 | 5/1972 | Driscoll | 102/485 |
| 3,768,189 | 10/1973 | Goodrich | 42/70.11 |

*Primary Examiner*—Ted L. Parr

*Attorney, Agent, or Firm*—Foley & Lardner, Schwartz, Jeffery, Schwaab, Mack, Blumenthal & Evans

[57] ABSTRACT

A gun safety device is detachably mounted on a gun barrel for capturing a projectile, wherein when mounted, at least a portion of the projectile capturing device breaks free of the gun, capturing a projectile fired therefrom. Optionally, the gun safety device can include a housing detachably mounted on the gun barrel and lockably attachable to the housing. The invention also includes a method for capturing a projectile from a gun.

28 Claims, 5 Drawing Sheets

PROJECTILE CAPTURING GUN SAFETY DEVICE

BACKGROUND OF THE INVENTION

1. Field of the Invention

This invention relates to a gun safety device. In particular, this invention relates to a gun safety device that captures a projectile fired from the gun.

2. Description of the Prior Art

In response to a growing crime rate, an increasing number of households are being armed with guns, such as rifles, handguns and the like. The possibility of confronting an intruder at a moment's notice has necessitated keeping a loaded gun or a readily loadable gun on hand. This growing trend has increased the need for effective gun safety devices. Additionally, accidents caused by inadvertent discharge or unauthorized use of a firearm are of major concern.

Many gun safety devices have been developed, including those that require a dummy cartridge, a key or complex trigger locking system, and those for use with a holster. A common disadvantage associated with these types of safety devices in the fact that they require considerable time and effort to arm the gun in response to an intruder. In the case of key lock devices, there remains the possibility of losing the key. Additionally, some devices are only effective for certain types of guns.

The art lacks a gun safety device that is compatible with all types of firearms. A device providing protection from harm due to accidental misfire that can be readily removed at a moment's notice does not currently exist.

SUMMARY OF THE INVENTION

It is therefore an object of the present invention to provide a gun safety device that can be easily secured to the barrel of a gun.

It is also an object of the present invention to provide a gun safety device that can be lockably attached to the barrel of a gun.

It is a further object of the present invention to provide a gun safety device that enables a gun to be easily and rapidly accessed to protect life and limb in the event of an emergency.

Another object of the present invention is to provide a gun safety device having projectile capturing means.

Still another object of the present invention is to provide a gun safety device having projectile capturing means that breaks free of the gun while capturing the fired projectile.

Broadly, the present invention comprises means detachably mounted on a gun barrel for capturing a projectile wherein at least a portion of the projectile capturing means breaks free of the gun, capturing a projectile fired therefrom. Optionally, the projectile capturing means can be lockably attached to the gun barrel.

The present invention also includes a method for capturing a projectile from a gun comprising the steps of mounting on a gun barrel a projectile capturing means having at least one breakaway chamber, firing a projectile from the gun, and capturing the projectile in the chamber.

BRIEF DESCRIPTION OF THE DRAWINGS

Other objects, features and advantages of the present invention will become apparent from the following detailed description and accompanying drawings wherein.

DETAILED DESCRIPTION OF THE PREFERRED EMBODIMENTS

Figure 1:
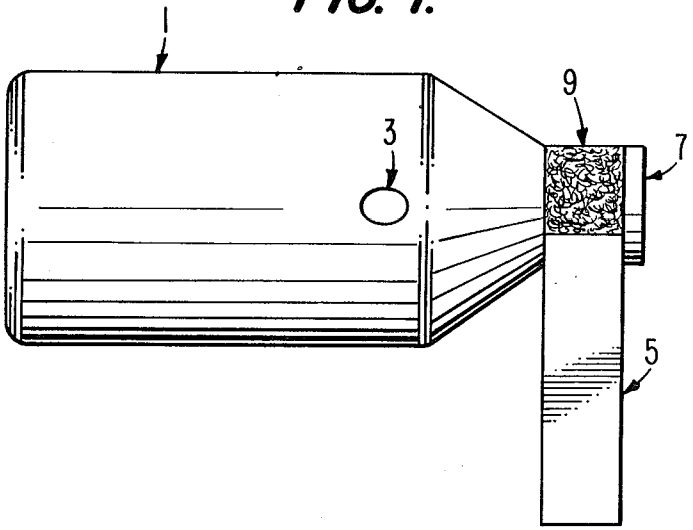
FIG. 1 is a side plan view of an embodiment of the gun safety device.
Figure 2:
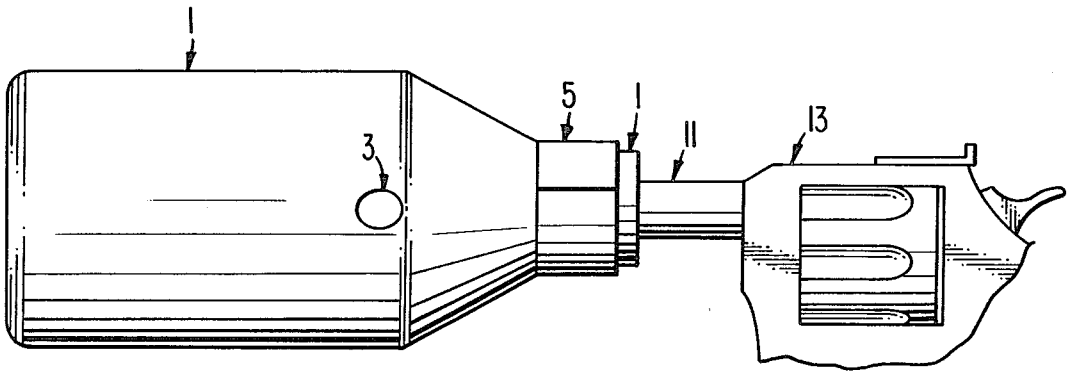
FIG. 2 is a side plan view of the gun safety device shown in FIG. 1 mounted on a gun barrel.

Referring to FIGS. 1 and 2, there is shown a projectile capturing device 1 having a compression release port 3 and a securing strap 5 disposed adjacent to an entrance aperture 7. The securing strap 5 has a strap securing portion 9 which enables the securing strap 5 to tightly secure the projectile capturing device 1 to a gun barrel. The securing strap can be of any type that securely fastens the projectile capturing device to a gun barrel, such as a Velcro TM design and the like.

The projectile capturing device of FIG. 1 can be installed by simply inserting a gun barrel 11 of a gun 13 into the entrance aperture 7 of the projectile capturing device 1, pulling the securing strap 5 tightly around the projectile capturing device until securely seated on the gun barrel 11 and then attaching the strap to the strap securing portion 9.

Figure 3:
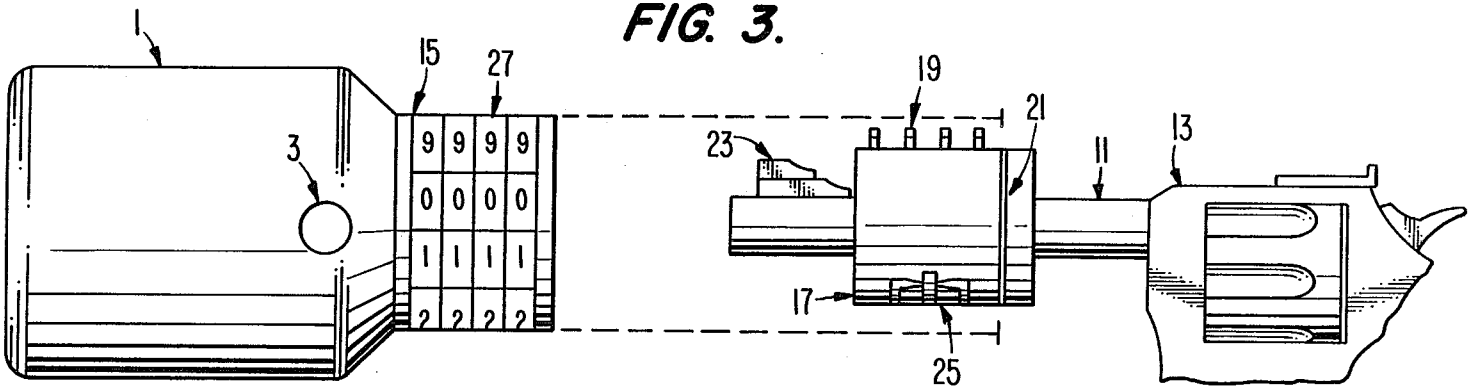
FIG. 3 is a side plan view of a further embodiment of the gun safety device in an unmounted position.
Figure 4:
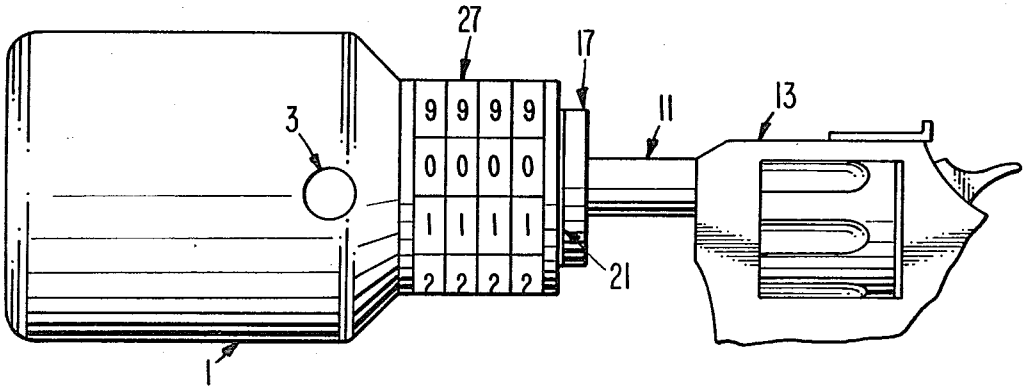
FIG. 4 is a side plan view of the gun safety device shown in FIG. 3 mounted to the barrel of a gun.
Figure 6B:
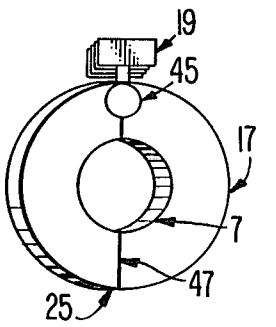
FIGS. 6*a–b* are perspective views of the housing shown in FIG. 3.
Figure 6A:
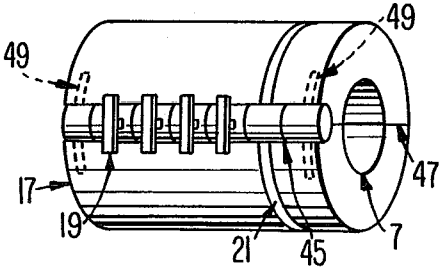
Figure 5:
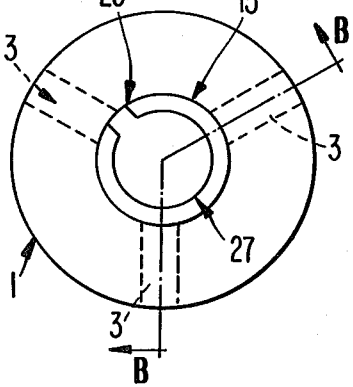
FIG. 5 is a cross-sectional view of the gun safety device shown in FIG. 3.
Figure 7D:
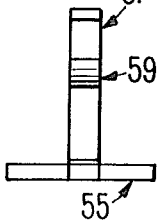
FIGS. 7*a–d* are perspective views of the housing clamping means shown in FIGS. 6*a–b* and 11*a–b;*
Figure 7C:
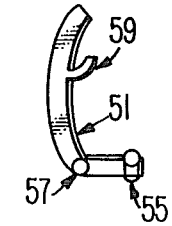
Figure 7B:
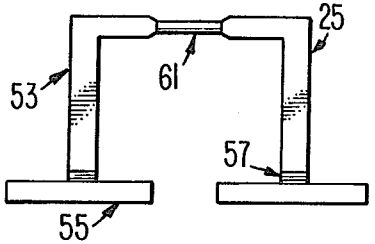
Figure 7A:
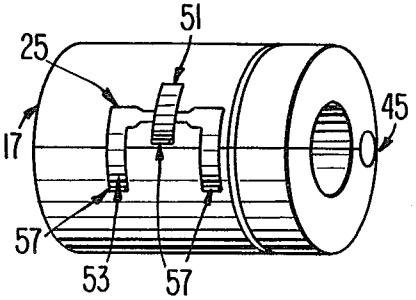

Referring to FIGS. 3–5, there is shown the projectile capturing device 1 having a combinationtype locking device 15 which lockably attaches the capturing device 1 to a housing 17. Receiving tabs 19 are disposed in the housing 17 which can lockably engage the combination-type locking device 15. The housing also includes a circumferential seat 21 which functions as a seal for preventing the escape of back pressure caused by the firing of a projectile. The housing 17 is placed over the gun barrel 11 adjacent to a gun sight 23 and tightly secured by a clamp 25.

The receiving tabs 19 comprise a plurality of tabs which are disposed in serial alignment along the cylindrical length of the housing 17. The tabs are engageable with the combination-type locking device 15.

The combination-type locking device 15, as shown in FIG. 5, comprises a plurality of serially aligned rotatable rings 27. Each ring 27 has a slot 29 which cooperates with the receiving tabs when the rings are rotated to a predetermined slot alignment. In this manner, when a predetermined combination is set, the slots 29 of the rings 27 are aligned and the housing 17 can be inserted into the projectile capturing device 1 until contacting the seat 21. When the projectile capturing device 1 has been installed, as shown in FIG. 4, the projectile capturing device can be lockably attached to the housing by randomly rotating the rings about the seated projectile capturing device. When placed in this lockably attached position, each ring is disposed between the tabs and can only be removed by being set to the predetermined combination which properly aligns the slots.

Although a four-digit combination is illustrated in the drawings, any number of digits can be used. The predetermined combination can be set up in an alphanumerical fashion. All four digits must be aligned in the correct combination for the capturing device to be installed. Once the capturing device is installed and the digits are randomly scrambled, removal is possible only by knowledge of the four-digit combination.

Referring to FIGS. *6a–b,* there is shown the housing 17 having a plurality of the receiving tabs 19 disposed in serial alignment along a hinge 45. The housing 17 comprises a hollow cylindrical twopiece body which is bisected along a plane 47. The hinge 45 is mounted to the housing by four anchor studs 49 and enables the housing to be spread apart and placed over the gun barrel. The clamp 25 is disposed on the non-hinged side of the two-piece body and enables the housing to be tightly secured to the gun barrel.

Referring to FIGS. *7a–d,* there is shown the housing clamp 25 comprising a throw-arm 51 and a catch-bar 53. The throw-arm 51 is hingedly implanted into one piece of the housing by an anchor stud 55 and a pivoting piece 57. A securing hook 59 is disposed adjacent to the non-pivoting end of the throw-arm and on the underside thereof. The catchbar 53 is hingedly implanted into the other piece of the housing by anchor studs 55 and pivot piece 57 in a like fashion. The catch-bar 53 has a rounded center 61 that is engageable with the throw-arm securing hook 59. The entire clamp is recessed below the surface of the housing and can be covered by the lockably attached projectile capturing device when installed. The housing can thus be tightly secured to the gun barrel by engaging the rounded center of the catch-bar with the securing hook of the throw-arm and clamped into place.

Figure 8:
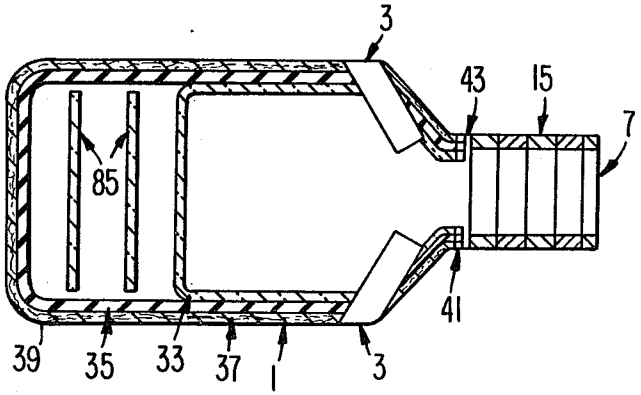
FIG. 8 is a cross-sectional view taken along the line B—B of FIG. 5.
Figure 9:
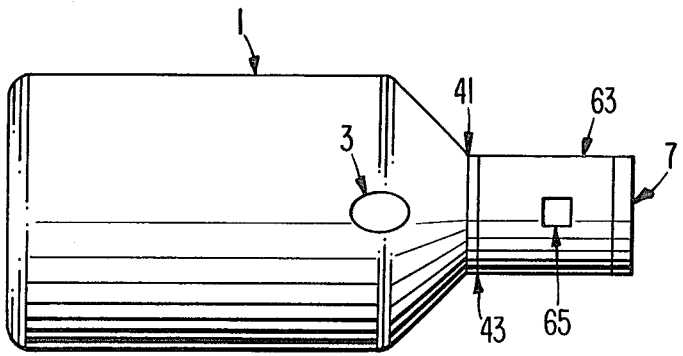
FIG. 9 is a side plan view of a further embodiment of the gun safety device.
Figure 11B:
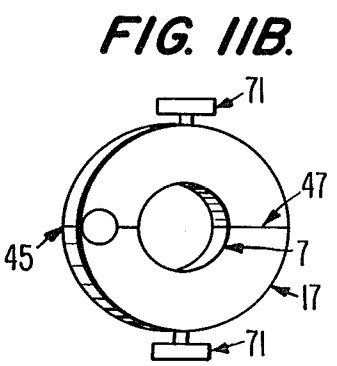
FIGS. 11*a–b* are perspective views of a further embodiment of the housing.
Figure 11A:
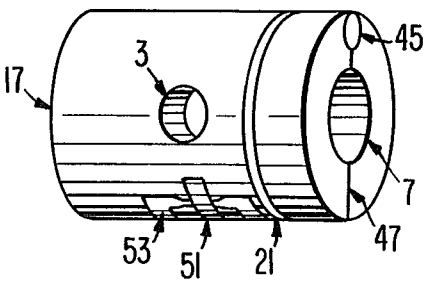

Referring to FIG. 8, there is shown a crosssectional view of the projectile capturing device having the combination-type locking device 15. The internal structure of the projectile capturing device 1 may be the same for each type of hollow cylindrical locking device disclosed. The projectile capturing device 1 has the entrance aperture 7 disposed at one end. The entrance aperture is at the end of the hollow cylindrical receiving device. A first chamber 33 is disposed at the end of the locking device opposite the entrance aperture 7. A second chamber 35 extends beyond the first chamber 33 in a direction opposite the entrance aperture 7. Additional chambers may be installed.

At least one disc 85, which may be made from a bullet proof material such as bullet proof glass or the like, may be inserted in a chamber or chambers of the projectile capturing device.

At least one compression release port 3 communicates between the first chamber 33 interior and the surrounding environment. The compression release ports prevent a premature release of the capturing device created by air and gasses due to the explosion of the projectile shell. Optionally, the capturing device may be provided without a compression release port.

An intermediate layer 37 encompasses the outer surfaces of both the first and second chambers. An exterior layer 39 encompasses the intermediate layer 35 and is secured to the locking device 15. A projectile fired from a gun enters the projectile capturing device through the entrance aperture 7 and passes the compression release ports 3. The projectile strikes the first chamber 33, which can be constructed of bulletproof material, and the second chamber 35 functions as a back-up chamber, which can also be made of bulletproof material, thus assuring the capture of the projectile in one of the chambers.

The intermediate layer can be formed from a layer of hardened rubber and the exterior layer can be formed from leather. The first and second chambers, intermediate and exterior layers, are connected by an attaching device 41 near the base of the locking device. Consequently, only the layer of leather is secured to the base, thus creating a weak point 43 which allows the separation of the capturing device from the base so that the base and housing do not get ripped off of the gun, damaging the gun barrel upon firing. The chamber materials may be treated with a flame retardant chemical and the like.

Referring to FIGS. 9–12, there is shown the projectile capturing device 1 having a quick-type locking device 63 with corresponding housing. The quick-type locking device 63 has an indicator port 65 which signals proper installation of the projectile capturing device 1.

Figure 10:
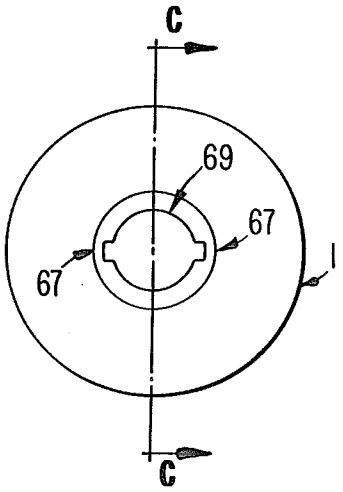
FIG. 10 is a cross-sectional view of the gun safety device shown in FIG. 9.

Referring to FIG. 10, there is shown a plurality of guide channels 67 disposed about the inside circumference of the quick-type locking device 63. Each of the guide channels extends from the entrance aperture to a spring 69 disposed adjacent to and opposite the entrance aperture and diverts in a radially outward direction from the spring. Each of the guide channels cooperates with a corresponding receiving post 71 when the projectile capturing device is placed over the housing so as to contact the housing seat. The projectile capturing device is then rotated to be lockably attached to the housing. The housing receiving post comprises a plurality of posts disposed about the outside circumference of the housing and spaced equidistant from each other.

Figure 12:
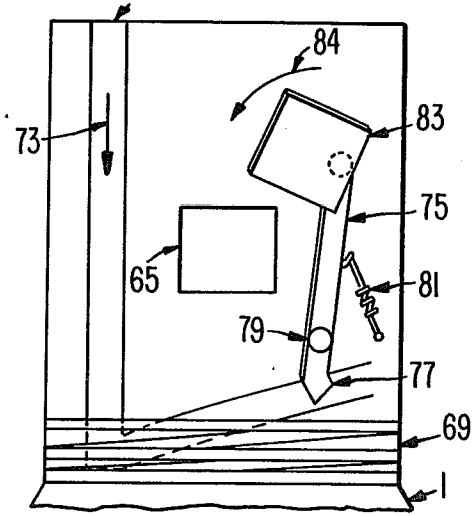
FIG. 12 is a cross-sectional view taken along the line C—C of FIG. 10.

Referring to FIG. 12, there is shown the indicator substructure of the quick-type locking device which signals the proper installation of the projectile capturing device. A receiving post enters the guide channel 67 and travels in the direction indicated by an arrow 73 until contacting the spring 69. The projectile capturing device is then rotated and the post contacts a spring-loaded flag rod 75 at a post receiving end 77 which pivots the flag rod 75 about a pivot rod 79 against the force of a return spring 81 and causes a flag indicator end 83 to move in the direction indicated by an arrow 84 until displayed in the indicator port 65 upon proper installation. The quick-type locking device is provided at the entrance aperture with a deformable end (not shown) which functions as a seal against the housing seat.

Figure 13:
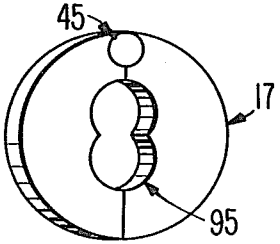
FIG. 13 is a perspective view of a further embodiment of a housing for an odd barrel configuration.

Referring to FIG. 13, there is show the housing 17 having an odd barrel configuration 95 for use with a double barrel gun or an obstruction such as a gun sight that cannot be avoided. The hinge 45 enables the housing 17 to be secured over a gun having an odd barrel configuration.

Figure 14:
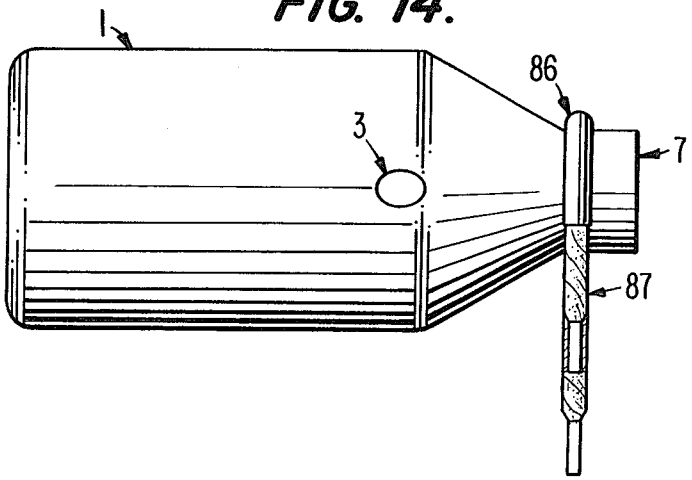
FIG. 14 is a side plan view of yet another embodiment of the gun safety device.

Referring to FIG. 14, there is shown the projectile capturing device 1 having a string-type securing portion 87 placed through a fabric tunnel 86. Once placed over the gun barrel the string is pulled tight and tied thereby securing the device to the gun. The projectile capturing device embodied by FIGS. 1, 2 and 14 may be provided without the weak point 43. Both projectile capturing device embodiments, that with the weak point 43 and that without the weak point 43 can function so as to capture a fired projectile without breaking away a portion of the capturing device.

The present invention also includes a method for capturing a projectile from a gun. This method includes the steps of mounting on a gun barrel a projectile capturing device having at least one chamber, firing a projectile from the gun, and capturing the projectile in the chamber. Optionally, the method can include the steps of mounting a housing on the gun barrel and attaching a lockable projectile capturing device having at least one breakaway chamber to the housing.

Further steps can include slot aligning a plurality of rotatable projectile capturing device rings, each having a slot, placing the slot aligned projectile capturing device over the housing having a plurality of tabs disposed in serial alignment so as to contact a seat disposed about the circumference of the housing, and randomly rotating the rings about the housing so as to lockably attach the projectile capturing cap to the housing.

A further embodiment of the method can include the steps of placing a projectile capturing device having a plurality of guide channels disposed about the inside circumference thereof, the channels receiving corresponding housing posts until the projectile capturing device contacts a seat disposed about the circumference of the housing and a post contacts a spring disposed within the channel, and rotating the capturing device so as to disengage the post from the spring and engage an indicator substructure signalling proper installation.

While several embodiments of the invention have been described, it will be understood that it is capable of still further modifications, and this application is intended to cover any variations, uses or adaptations of the invention, following in general the principles of the invention and including such departures from the present disclosure as to come within knowledge or customary practice in the art to which the invention pertains, and as may be applied to the essential features hereinbefore set forth and falling within the scope of the invention or the limits of the appended claims.

What is claimed is:

1. A gun safety device comprising:

(a) means for capturing a projectile; and (b) means for mounting said capturing means on a gun barrel, sadi mounting means including means for breaking at least a portion of said capturing means free from the mounting means upon the firing og the projectile.

2. The device of claim 1, wherein said mounting means further comprises:

(a) a housing detachably mounted on the gun barrel; and (b) means disposed in said projectile capturing means for locking said projectile capturing means to said housing.

3. The device of claim 1, wherein said mounting means further comprises a housing which comprises a hollow, cylindrical two-piece body bisected substantially the entire length along a diameter of said cylindrical body; means disposed along the length of a side of said housing for hinging the two-piece body so as to enable the housing to be spread apart and placed over said barrel; and means for clamping the non-hinged side of said two-piece body so as to tightly secure said housing to the gun barrel.

4. The device of claim 3, wherein said clamping means comprises:

(a) a throw-arm having at one end a first anchor stud hingedly implanted into one piece of said housing and a securing hook disposed adjacent to the other end of said throw-arm; and (b) a catch-bar having at each end a second and a third anchor stud, respectively, hingedly implanted into the other piece of said housing and a rounded center engageable with said throw-arm securing hook.

5. The device of claim 3, wherein said clamping means is recessed below the surface of said housing and covered by said projectile capturing means when mounted.

6. The device of claim 1, wherein said projectile capturing means further comprises:

(a) an entrance aperture disposed at an end of said mounting means;

(b) a first chamber disposed at an end of said mounting means opposite said entrance aperture;

(c) a second chamber extending beyond said first chamber in a direction opposite said entrance aperture;

(d) at least one compression release port communicating between said first chamber interior and the surrounding environment;

(e) an intermediate layer encompassing the outer surface of said first and second chambers; and (f) an exterior layer encompassing said intermediate layer and secured to said mounting means.

7. The device of claim 6, wherein said first and second chambers each comprise a bulletproof-type material.

8. The device of claim 7, wherein said intermediate layer comprises hardened rubber.

9. The device of claim 8, wherein said exterior layer comprises leather.

10. the device of claim 6, wherein said projectile capturing means further comprises a disc disposed within at least one of said first and said secon chambers.

11. The device of claim 1, wherein said mounting means further comprise a housing mounted to the gun barrel, said housing comprising a plurality of tabs disposed in serial alignment on said housing, said tabs being engageable with said capturing means.

12. The device of claim 11, wherein said mounting means further comprises a plurality of serially aligned rotatable rings attached to said capturing means, each of said rings having a slot, said slots cooperating with an equal number of said tabs when said rings are rotated to a predetermined slot alignment and said projectile capturing means is placed over said housing so as to contact a seat disposed about the circumference of said housing.

13. The device of claim 12, wherein said projectile capturing means is lockably attached to said housing when said slot aligned rings are randomly rotated about said seated projectile capturing means.

14. The device of claim 1, wherein said mounting means further comprises a housing mounted to the gun barrel, said housing comprising a plurality of posts disposed about the outside circumference of said housing and equidistant from each other, said posts being engageable with said capturing means.

15. The device of claim 14, wherein said mounting means further comprises a plurality of guide channels disposed about the inside circumference of said capturing means, each of said guide channels extending from an entrance aperture of said capturing means to a spring disposed adjacent to the end opposite said entrance aperture and diverting in a radially outward direction from said spring, each of said guide channels cooperating with a corresponding post when said projectile capturing means is placed over and rotated about said housing so as to contact a seat disposed about the circumference of said housing.

16. The device of claim 1, wherein said mounting means further comprises an indicator substructure signalling proper installation of said projectile capturing means.

17. The device of claim 16, wherein said indicator substructure comprises a spring-loaded flag rod having a post receiving end, a flag indicator end and a pin disposed between said ends pivotally securing said flag rod to said mounting means, whereby said flag indicator is displayed when a mounting means post activates said post receiving end upon proper installation.

18. The device of claim 1, wherein said projectile capturing means further comprises:

(a) an entrance aperture disposed at an end of said mounting means;
(b) a first chamber disposed at an end of said mounting means opposite said entrance aperture;
(c) at least one compression release port communicating between said first chamber interior and the surrounding environment;
(d) an intermediate layer encompassing the outer surface of said first chamber; and
(e) an exterior layer encompassing said intermediate layer and secured to said mounting means.

19. The device of claim 18, wherein said projectile capturing means further comprises a disc disposed within said first chamber.

20. The device of claim 1, wherein said projectile capturing means further comprises:

(a) an entrance aperture disposed at an end of said mounting means;
(b) a first chamber disposed at an end of said mounting means opposite said entrance aperture;
(c) a second chamber extending beyond said first chamber in a direction opposite said entrance aperture;
(d) an intermediate layer encompassing the outer surface of said first and second chambers,; and
(e) an exterior layer encompassing said intermediate layer and secured to said mounting means.

21. The device of claim 20, wherein said projectile capturing means further comprises a disc disposed within at least one said first and said second chambers.

22. The device of claim 1, wherein said projectile capturing means further comprises:

(a) an entrance aperture disposed at an end of said mounting means;
(b) a first chamber disposed at an end of said mounting means opposite said entrance aperture;
(c) an intermediate layer encompassing the outer surface of said first chamber; and
(d) an exterior layer encompassing said intermediate layer and secured to said mounting means.

23. The device of claim 22, wherein said projectile capturing means further comprises a disc disposed within said first chamber.

24. A gun safety device comprising:

(a) means for capturing a projectile fired from a gun having a barrel;
(b) means for mounting said capturing means on said gun barrel; and
(c) said capturing means including a projectile apeture and at least one compression release port releasing gases from the capturing means upon the firing of a projectile into the capturing means.

25. A method for capturing a projectile from a gun comprising the steps of:

(a) mounting on a gun barrel a projectile capturing means having a projectile entrance aperture and at least one chamber;
(b) firing a projectile from the gun ; and
(c) capturing the projectile in said at least one chamber; and
(d) releasing gases from the capturing means through a compression release port upon the firing of the projectile into the capturing means.

26. A method for capturing a projectile from a gun comprising the steps of:

(a) mounting a housing on the gun barrel;
(b) attaching a lockable projectile capturing means to said housing, said projectile capturing means having at least one chamber;
(c) firing a projectile from the gun;
(d) capturing the projectile in said at least one chamber; and
(e) breaking at least a portion of said capturing means free from the housing upon the firing of the projectile into said capturing means.

27. The method of claim 26, wherein step (b) further comprises the substeps of: (i) slot-aligning a plurality of rotatable projectile capturing means rings, each having a slot; (ii) placing said slot-aligned projectile capturing means over said housing having a plurality of tabs disposed in serial alignment so as to contact a seat disposed about the circumference of said housing; and (iii) randomly rotating said rings about said housing so as to lockably attach said projectile capturing means to said housing.

28. The method of claim 26 wherein step (b) further comprises the substeps of: (i) placing a projectile capturing means having a plurality of guide channels disposed about the inside circumference thereof, said channels receiving corresponding housing posts, until said capturing means contacts a seat disposed about the circumference of said housing and said post contacts a spring disposed within said channel; and (ii) rotating said capturing means so as to disengage said posts from said spring and engage an indicator substructure signalling proper installation.

* * * * *